United States Patent [19]

Kobayashi et al.

[11] 4,241,689

[45] Dec. 30, 1980

[54] COATING APPARATUS

[75] Inventors: Shigeru Kobayashi, Hino; Takemasa Namiki, Iruma; Tsutomu Iwamoto, Hachiohji, all of Japan

[73] Assignee: Konishiroku Photo Industry Co., Ltd., Tokyo, Japan

[21] Appl. No.: 887,659

[22] Filed: Mar. 17, 1978

[30] Foreign Application Priority Data

Mar. 26, 1977 [JP] Japan ..... 52-33451

[51] Int. Cl.[3] ..... B05C 5/02

[52] U.S. Cl. ..... 118/50; 118/407

[58] Field of Search ..... 118/50, 407, 412, 411; 427/356, 358, 294

[56] References Cited

U.S. PATENT DOCUMENTS

| | | | |
|---|---|---|---|
| 3,220,877 | 11/1965 | Johnson | 118/412 X |
| 3,676,178 | 7/1972 | Browatzki et al. | 118/412 X |
| 3,928,678 | 12/1975 | Jackson | 118/411 X |
| 4,019,816 | 4/1977 | Bernhard | 118/407 X |

*Primary Examiner*—John P. McIntosh

*Attorney, Agent, or Firm*—Martin A. Farber

[57] ABSTRACT

A coating apparatus is disclosed. The apparatus comprises a coating head having a slide face along which a coating liquid flows down and a roll moving a continuous web downwardly. The slide face and the roll define a space for forming a sustained liquid mass therein. The coating head has a bottom face which is provided with a groove in the proximity of and substantially parallelly to the slide face whereby a thin liquid film is formed on the web at high speed.

6 Claims, 3 Drawing Figures

COATING APPARATUS

FIELD OF THE INVENTION

This invention relates to a coating apparatus for applying a thin layer of coating liquid to a continuous web at high speeds and more particularly a coating apparatus used in the production of photographic materials.

DESCRIPTION OF THE PRIOR ART

As coating apparatus for applying a coating liquid to a moving web, there has been known for examples a slide hopper type apparatus and a double roll type apparatus.

These known apparatus are unavailable to apply a thin coating to the web at high speeds of 50 to 100 meters per minute so that a layer of 5 to 150$\mu$ thickness in wet state is formed on the web. The reason for this is that a liquid mass formed between a coating head and a web is destroyed by a stress in the mass and air carried by the web, this phenomenon being caused by the movement of the web at a relatively large velocity. The above-mentioned thin layer coating at high speed has been demanded in photographic industry recently.

In order to overcome the aforesaid disadvantage, the applicant proposed a coating method in a Japanese Patent Application Sho 50/122786. This method comprises moving downwardly a continuous web, positioning a coating head in the proximity of the web to form a wedge-shaped space between a slide face of the coating head and the web, supplying a coating liquid to the space to form a sustained liquid mass whereby a layer of the coating liquid is applied to the web and applying an air pressure to the layer below the mass. By this method, a thin coating of 5 to 150$\mu$ thickness in wet state can be obtained with high speeds of 50 to 100 meters per minute.

As a result of more extensive investigation, the inventors found that the aforesaid method includes some problems such that products are relatively poor in high eveness of the coating, particularly inevitable of longitudinal surface irregularity.

BRIEF SUMMARY OF THE INVENTION

An object of this invention is to improve the aforesaid coating method.

Another object of this invention is to provide a coating apparatus suitable for applying a thin coating to a continuous web at high speeds.

A still another object of this invention is to provide a coating apparatus in which thickness of the coating can be adjusted.

According to this invention, the above-mentioned objects are attained by a coating apparatus which comprises means for moving downwardly a continuous web along a predetermined path, a coating head positioned in the proximity of said moving means, said coating head having a slide face which defines a wedge-shaped space in cooperation with said web and a bottom face which is provided with a groove in the proximity of and substantially parallelly to said slide face, means for supplying a coating liquid composition to said space to form a sustained liquid mass in said space whereby a layer of the coating liquid composition is applied to the web, and means for applying an air pressure to said layer below said liquid mass.

By the provision of the groove, a stable liquid mass can be formed between the web and the slide face, so that a layer on the web is formed with extremely high eveness in thickness.

According to a preferred embodiment of this invention, there is provided a coating head with the following arrangement and shape.

$\alpha = 0°$ to $60°$ $\theta = 80°$ to $150°$ $l = 0.1$ to $1.0$ mm wherein $\alpha$ is an angle defined by the slide face and a plane tangential to the web at a position that the low end edge of the slide face and the web opposes each other, $\theta$ is an angle defined by the bottom face and the tangential plane, and l is a length of the bottom face from the low end edge of the slide face to a boundary line of the bottom face and the groove.

Other objects and advantages of this invention will be understood by the description hereinbelow and drawings accompanied.

DETAILED DESCRIPTION OF THE EMBODIMENTS

Figure 1:
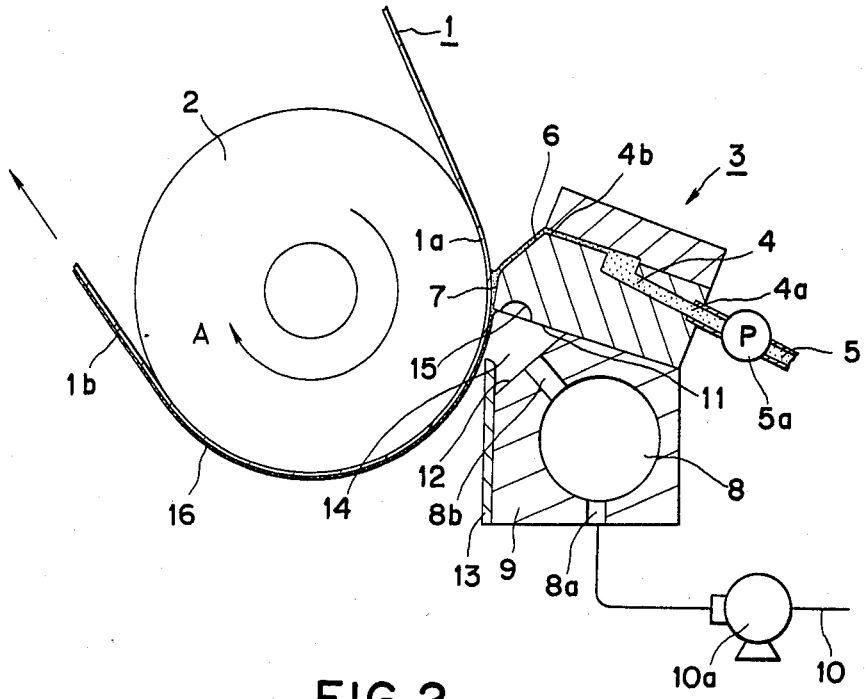
FIG. 1 is a cross sectional view of an embodiment of this invention.
Figure 2:
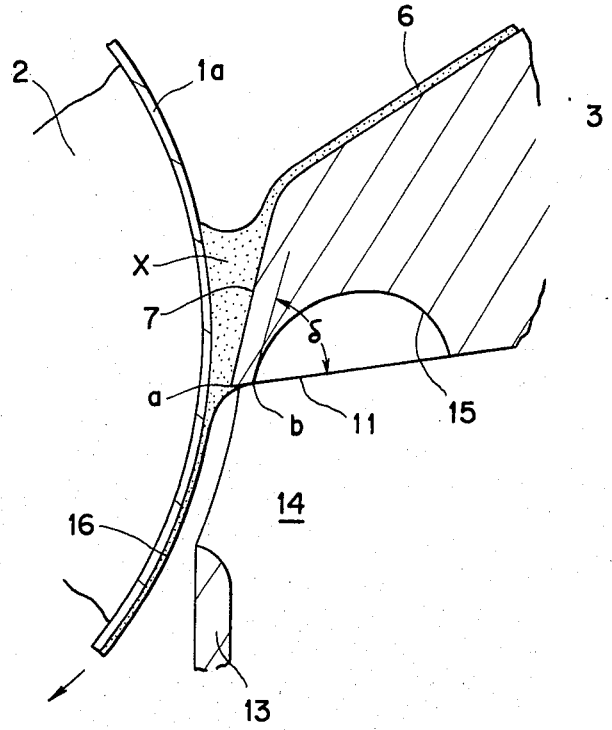
FIG. 2 is an enlarged sectional view of a coating station of the embodiment.
Figure 3:
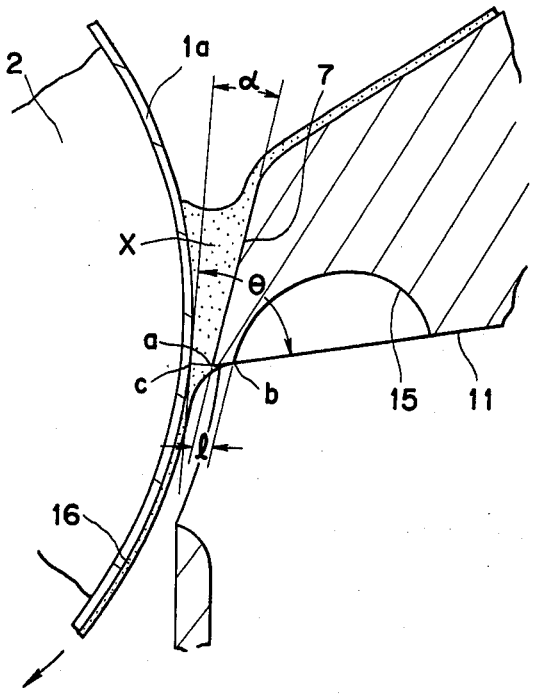
FIG. 3 is an enlarged sectional view illustrating an arrangement and a shape of a coating head of the embodiment.

Referring to FIG. 1, a continuous web is moved by a roll 2 at a direction designated by an arrow A and a speed of 50 to 100 meters per minute. In the following explanation, a web portion which moves downwardly is termed as 1*a* and another web portion which moves upwardly is termed as 1*b* for easy understanding. A coating head 3 which is provided with a slot 4 for supplying a coating liquid is positioned in the proximity of the roll 2. The coating head 3 is also positioned to oppose the web portion 1*a*. The slot 4 communicates with a pipe 5 which is connected to a pump 5*a*. The coating liquid is supplied by the pump 5*a* through the pipe 5 and the slot 4 at a regulated rate. A discharge end 4*b* of the slot 4 locates at the uppermost end of a front face 6 of the coating head 3. The width of the coating is defined by the length of the discharge end 4*b*. In a preferred embodiment, the length of the discharge end 4*b* is determined to be slightly smaller than the width of the web. In another embodiment in which stripe coatings are obtained, a plurality of the discharge ends is provided. A coating liquid discharged from the discharge end 4*b* flows downwardly along the front face 6. The coating head 3 is provided with a slide face 7 succeedingly to the front face 6. The slide face 7 defines a wedge-shaped space X in cooperation with the web 1*a* to form a sustained liquid mass therein. The coating apparatus is provided with a block 9 under the coating head 3. The block 9 is provided with a chamber 8 and conduits 8*a* and 8*b*. The conduit 8*a* communicates with an air pump 10*a*. The roll 2, the coating head 3, the block 9 and a plate 13 which is fixed to the block 9 form a chamber 14. A coated layer is subjected to an air pressure when passing through the chamber 14. The pressure is determined to be a value of an atmosphere plus 50 to 500 mm Aq. This value relates to the speed of web movement, the rate of the coating liquid composition supply and, etc. The coating head 3 also has a bottom face 11 which is provided with a groove 15. The groove 15 is formed in the proximity of and substantially parallelly to the slide face 7. An edge b defined by the bottom face 11 and the rising portion of the groove 15 adjacent the web is preferably formed to have an edge angle δ smaller than 150°. The inventors found such phenomenon that the liquid extends along the bottom face 11 as shown in FIG. 2 and FIG. 3. If such extension is locally irregular, the thickness of a coated layer becomes uneven. The edge b defined by the groove 15 limits the extension of the liquid, so that the extension is uniformly regulated. A layer which is highly uniform in thickness is formed on the web.

According to another aspect of this invention, the arrangement and shape of the coating head are determined as follows:

Suppose that a point on the web 1 nearest to the low end edge a of the slide face 7 is referred as c and an angle defined by the slide face 7 and a plane tangential to the web at the point c is referred as α, α should be 0° to 60°

If the angle α is negative, the space defined by the web and the slide face 7 has such configuration that the width of the lowest end of the space is longer than that of the upper position of the space. As the result, a liquid mass formed in the space becomes unstable to cause uneveness of the thickness of the coated layer. If the angle α is larger than 60°, the compression force impressed to the coating liquid in the space becomes small, so that the liquid mass becomes unstable. This is prominent in high speed coating and when viscosity of coating liquid composition is high. The sustained liquid mass is stably held by the pressure impressed to the coating below the liquid mass. When θ is smaller than 80°, the liquid mass becomes unstable, so that continuous coating becomes impossible. When θ is larger than 150°, the mass of a liquid extending along the bottom face becomes too large, so that longitudinal irregularities of the coating layer occur. The distance l between the point a and the point b should be 0.1 to 1.0 mm. If the distance l is smaller than 0.1 mm, the bottom face of the coating head becomes extremely narrow, so that the bottom portion of the coating head has a shape of a knife-like sharp edge. As the result, the mass becomes unstable. If the distance l is larger than 1.0 mm, the coating liquid irregularly extends along the bottom face of the coating head, so that the mass becomes unstable to cause uneveness in thickness of the coated layer.

Examples of this invention will be explained hereinbelow.

EXAMPLE 1

A coating process was conducted using the coating apparatus shown in FIG. 1, wherein a polyethylene telephthalate film was used as the web; a photographic emulsion liquid having a viscosity of 2.0 cP was used as the coating liquid composition; a coating speed was determined to be 80 meters per minute; the spacing between the surface of the web and the low end point of the slide face was determined to be 100μ; the pressure in the pressure chamber 14 was determined to be 200 mm Aq (designated as a value indicated on a gauge); and the angles α and θ, the distance l and the angle δ were determined to be respectively 5°, 85°, 1.0 mm and 80°. A coated layer having a thickness of 20μ in wet state was obtained. Products thus prepared were free from longitudinal coating defect as well as uneveness in the thickness of coated layers, which were often found in products applied with coating compositions of low viscosity in conventional coating process.

EXAMPLE 2

A coating process was conducted using the coating apparatus shown in FIG. 1, wherein a polyethylene laminate aluminum film was used as the web; a photographic emulsion liquid having a viscosity of 50 cP was used as the coating liquid composition; a coating speed was determined to be 60 meters per minute; the spacing between the surface of the web and the low end point of the slide face was determined to be 150μ; the pressure in the pressure chamber was determined to be 100 mm Aq; and the angles α and θ, the distance l and the angle δ were determined to be 40°, 140°, 0.1 mm and 80°.

A coated layer having a thickness of 35μ in wet state was obtained.

This invention should not be limited by the examples and any modification is possible without differing from the scope of claims. For example, other coating compositions than photographic emulsions can be used.

What is claimed is:

1. A coating apparatus comprising means for moving downwardly a continuous web along a predetermined path;

a coating head positioned in the proximity of a downwardly moving portion of the web, said coating head having a slide face which defines a wedge-shaped space in cooperation with said web and said coating head having a bottom face extending substantially perpendicularly to said web adjacent thereto and formed with a groove in the proximity of and substantially parallel to said slide face whereby and effective bottom face portion is defined between said slide face and said groove;

means for supplying a coating liquid composition to said space and forming a sustained liquid mass in said space whereby a coating is applied to said web, including means for applying air pressure of an atmosphere plus 50 to 500 mm. Aq. to said coating on said web below said mass.

2. A coating apparatus according to claim 1 wherein said groove has a rising portion adjacent said web, an edge defined by the bottom face and the rising portion of said groove has an angle smaller than 150°.

3. A coating apparatus according to claim 1 wherein said coating head has the following arrangement and shape α=0° to 60°

θ=80° to 150° l=0.1 to 1.0 mm wherein α is an angle defined by said slide face and a plane tangential to said web at a position that the low end edge of said slide face and said web opposes each other, θ is an angle defined by said bottom face and said tangential plane, and l is a length of said effective bottom face.

4. A coating apparatus according to claim 1 wherein said coating head has a face preceding to said slide face, and the coating liquid composition is supplied to said space through said preceding face.

5. A coating apparatus according to claim 1, wherein said means for applying air pressure applies compressed air to a lower surface of said liquid mass to support the latter.

6. The coating apparatus according to claim 5, wherein said coating head has a top face portion adjacent said slide face, said liquid mass defines an upper surface, said upper and lower surfaces of said liquid mass extend from said top and bottom face portions, respectively, to said web and are concave.

* * * * *